US008353134B2

(12) United States Patent
Jiang et al.

(10) Patent No.: US 8,353,134 B2
(45) Date of Patent: Jan. 15, 2013

(54) GROUTED TUBULAR ENERGY-DISSIPATION UNIT

(75) Inventors: Shou Chao Jiang, Shanghai (CN); Yuan Yuan Zhao, Shanghai (CN); Guo Qiang Li, Shanghai (CN); Zhen Wang, Shanghai (CN); Xiao Lin Zhao, Shanghai (CN)

(73) Assignee: Tongji University, Yangpu District, Shanghai (CN)

( * ) Notice: Subject to any disclaimer, the term of this patent is extended or adjusted under 35 U.S.C. 154(b) by 198 days.

(21) Appl. No.: 12/863,896

(22) PCT Filed: Mar. 10, 2010

(86) PCT No.: PCT/CN2010/070948

§ 371 (c)(1),
(2), (4) Date: Jul. 21, 2010

(87) PCT Pub. No.: WO2010/115356

PCT Pub. Date: Oct. 14, 2010

(65) Prior Publication Data

US 2011/0041424 A1 Feb. 24, 2011

(30) Foreign Application Priority Data

Apr. 7, 2009 (CN) ..... 2009 1 0048897
Apr. 7, 2009 (CN) ..... 2009 1 0048898
Apr. 7, 2009 (CN) ..... 2009 1 0048899
Apr. 7, 2009 (CN) ..... 2009 1 0048900

(51) Int. Cl.
*E04B 1/98* (2006.01)

(52) U.S. Cl. ..... 52/167.1; 52/834

(58) Field of Classification Search ..... 52/167.1, 52/167.3, 834, 835
See application file for complete search history.

(56) References Cited

U.S. PATENT DOCUMENTS 5,799,924 A * 9/1998 Slocum et al. ..... 248/636
6,701,680 B2 * 3/2004 Fanucci et al. ..... 52/167.3
7,185,462 B1 * 3/2007 Smelser ..... 52/167.3
7,707,788 B2 5/2010 Bystricky et al.
2008/0229683 A1 9/2008 Bystricky

FOREIGN PATENT DOCUMENTS

CN 100999916Y A 7/2007
CN 2743444Y A 9/2008
CN 101514570 A 8/2009

(Continued)

*Primary Examiner* — Basil Katcheves
(74) *Attorney, Agent, or Firm* — Global IP Services; Tianhua Gu

(57) ABSTRACT

The present invention discloses a grouted tubular energy-dissipation unit comprising an inner tube and an outer tube. The inner tube is coaxially inserted into the outer tube defining a gap within a lapping portion of the tubes for receiving expansive cement grout. After solidified, the expansive cement grout forms an expansive ring. A prestress produced by the expansive cement grout increases the friction between the expansive ring and the tubes. In service, the present invention can transfer the axial force via the friction between the tubes and the expansive cement grout. In case of earthquake, the sliding friction between the tubes and the expansive cement grout can absorb energy. The present invention does not require high precise in manufacturing and constructing, saves steel and has low cost. It is only need to replace the grouted tubular energy-dissipation unit when the present invention is damaged in earthquake, which is very convenient.

11 Claims, 4 Drawing Sheets

FOREIGN PATENT DOCUMENTS

| | | | |
|---|---|---|---|
| CN | 101525910 | A | 9/2009 |
| CN | 101525911 | A | 9/2009 |
| CN | 101525912 | A | 9/2009 |
| JP | 1990-225772 | | 9/1990 |
| JP | P1993-18138 | | 1/1993 |
| JP | 1993-64367 | | 8/1993 |
| JP | P2001-227175 | A | 8/2001 |
| JP | P2006-291469 | A | 10/2006 |

* cited by examiner

GROUTED TUBULAR ENERGY-DISSIPATION UNIT

CROSS REFERENCE TO RELATED PATENT APPLICATION

The present application is the US national stage of PCT/CN2010/070948 filed on Mar. 10, 2010, which claims priorities of Chinese patent applications No. 200910048900.2 filed on Apr. 7, 2009, No. 200910048899.3 filed on Apr. 7, 2009, No. 200910048897.4 filed on Apr. 7, 2009 and No. 200910048898.9 filed on Apr. 7, 2009 that applications are incorporated herein by reference.

BACKGROUND OF THE PRESENT INVENTION

1. Field of Invention

The present invention relates to a brace of a building structure, and more particularly to an energy-dissipation unit used in the brace for reducing the destruction to buildings and constructions caused by earthquake.

2. Description of Related Arts

More and more multi-store buildings and high-rise buildings are constructed, so that seismic resistant design attracts continuous efforts from researchers. The conventional seismic resistant design focuses on "resisting", which has drawbacks of high cost and low reliability. Therefore, a structure controlling technology is developed. The structure controlling technology includes active structure controlling technology and passive structure controlling technology. Energy dissipation brace is a common passive structure controlling technology, which can be used for the earthquake effect-reduction of newly built construction and existing construction.

Ordinary energy dissipation brace is not used for load-bearing, and can be disposed between columns or shear walls. Ordinary energy dissipation brace is formed by installing dissipation joint or damper to the ordinary brace. The brace including dissipation joint or damper does not take loads in service or under frequent earthquakes. In case of intense earthquake, when the main structure members are subjected to large displacements or high velocity, the energy dissipation braces start to slide or rotate, which will increase the damping or friction that can dissipate the energy inputted from vibration of base so as to reduce seismic action and protect the main structure from severe damage. At present, many kinds of energy dissipation braces have been developed, which can be grouped into three categories: friction energy dissipation brace, viscous damper (VD) and buckling restrained brace (BRB).

The friction energy dissipation brace absorbs energy by the sliding of metal plates; the VD is made of viscoelastic material. VD is related to the velocity, which dissipates energy inputted from vibration of base via the damping produced by the transformation of the viscoelastic material. BRB utilizes the hysteretic performance of metals, which yield into plastic range to absorb energy. The conventional energy dissipation brace is to connect dissipation element or damper to the ordinary brace, or is made of high ductile metal materials, which has drawbacks of high cost, inconvenience to be installed, get maintenance or be replaced, and high precise requirement in manufacturing and constructing.

SUMMARY OF THE PRESENT INVENTION

In order to overcome the above-mentioned drawbacks, the present invention provides an energy-dissipation unit that is convenient to provide maintenance and be replaced, simple to be manufactured and be installed, and has high performance with low cost. The present invention can provide earthquake effect-reduction solution for newly built construction and existing construction, and can serve as load-bearing structural member of buildings in service.

The present invention provides an grouted tubular energy-dissipation unit, comprising: an inner tube and an outer tube, wherein the inner tube is coaxially inserted into the outer tube defining a gap within a lapping portion between the inner tube and the outer tube, wherein an expansive cement grout is provided in the gap, and the expansive cement grout after solidified forms an expansive ring.

Preferably, a reinforcing steel bar is provided in the expansive cement grout.

Preferably, the reinforcing steel bar is spiral steel bar or circular wire mesh panel.

Preferably, a metal skin peripherally coats on an outer surface of the lapping portion of the inner tube, a plurality of spaced longitudinal steel bars distributed along an axis of the inner tube is provided on an outside surface of the metal skin, and a plurality of steel headers extruding outwardly along a radical direction of the inner tube is provided on the longitudinal steel bar.

Preferably, two edges of the metal skin overlaps and can slide relatively.

Preferably, a shear key is provided on an inner surface of the outer tube within the lapping portion.

Preferably, the shear key is weld dot, weld line, truncated steel bar or stud that welded on an inner surface of lapping portion of the outer tube.

Preferably, an outer annular plate is provided on an outer end of the lapping portion of the inner tube and the outer tube; an inner annular plate is provided on an inner end of the lapping portion of the inner tube and the outer tube; the outer annular plate and inner annular plate are fixedly connected with the outer tube; the inner annular plate, outer annular plate, the inner tube and the outer tube define a grouting cavity; the grouting cavity has a grouting hole provided on a wall thereof; the expansive cement grout is provided inside the grouting cavity.

Preferably, the grouting hole is provided on the inner annular plate, the outer annular plate, or the outer tube.

Preferably, an outer annular plate is provided on an outer end of the lapping portion of the inner tube and the outer tube; an inner annular plate is provided on an inner end of the lapping portion of the inner tube and the outer tube; the outer annular plate and inner annular plate are fixedly connected with the outer tube; the inner annular plate, outer annular plate, the outer tube and the metal skin enveloped on the inner tube define a grouting cavity; the grouting cavity has a grouting hole provided on a wall thereof; the expansive cement grout is provided inside the grouting cavity.

Preferably, the grouting hole is on the inner tube, and the metal skin has a hole at a corresponding place.

Preferably, fiber or sand is mixed into the expansive cement grout.

Preferably, the fiber is carbon fiber, steel fiber, or glass fiber.

The advantages of the present invention are illustrated as follows. The present invention utilizes the prestress produced by the expansive cement grout so as to increase the friction between the expansive ring and the steel tubes. In normal condition, the present invention can bear large axial load and is as rigid as ordinary brace. In case of earthquake, the present invention can dissipate and absorb energy via the relative slide between the inner tube and the outer tube. The present invention does not require high manufacture precision, can save steel, has low cost, and can be manufactured in standard mass production. When the present invention is damaged in earthquake, it is only need to replace the grouted tubular energy-dissipation unit, which is very convenient.

The present invention can replace the existing friction energy dissipation brace, VD, and BRB. Grouted tubular connections have been used in the construction engineering, but only used for steel tube connections. It has not been realized that the grouted tubes can be used for the energy dissipation of multi-store buildings, high-rise buildings and space structure. The present invention provides an earthquake effect-reduction technology for both newly-built construction and existing construction, which is easy to be manufactured and has low cost.

DETAILED DESCRIPTION OF THE PREFERRED EMBODIMENT

The present invention is further explained in detail according to the accompanying drawings.

Figure 1:
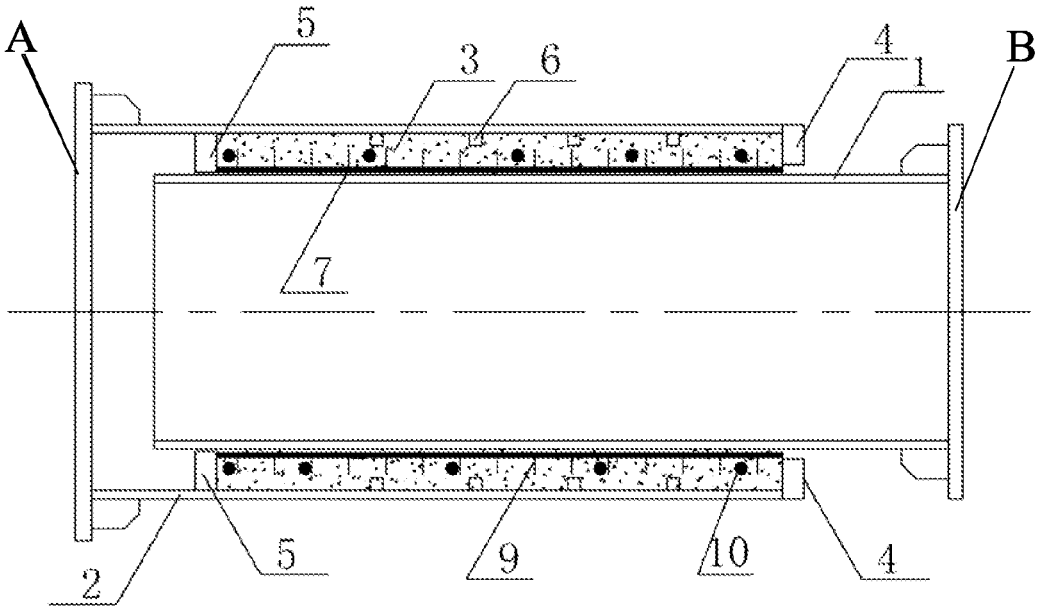
FIG. 1 is a perspective view of a grouted tubular energy-dissipation unit according to a preferred embodiment of the present invention.
Figure 2:
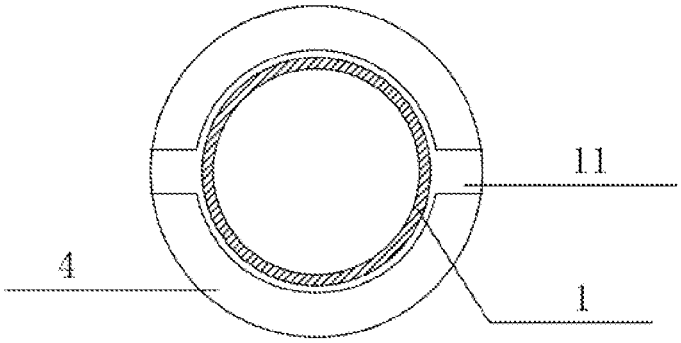
FIG. 2 is a perspective view of an annular plate according to the above preferred embodiment of the present invention.
Figure 3:
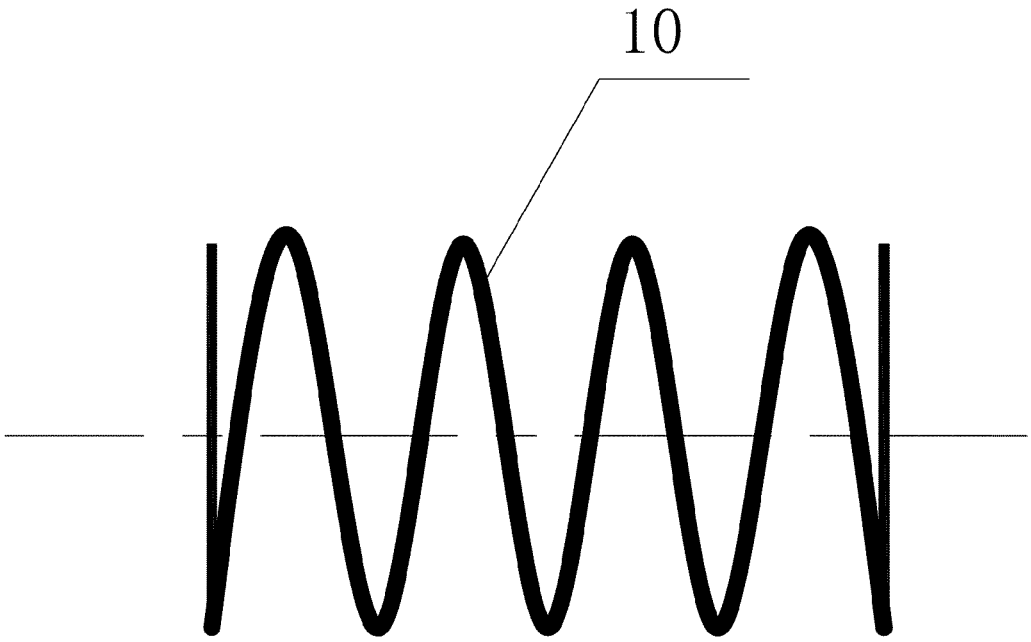
FIG. 3 is a perspective view of a spiral steel bar according to the above preferred embodiment of the present invention.
Figure 4:
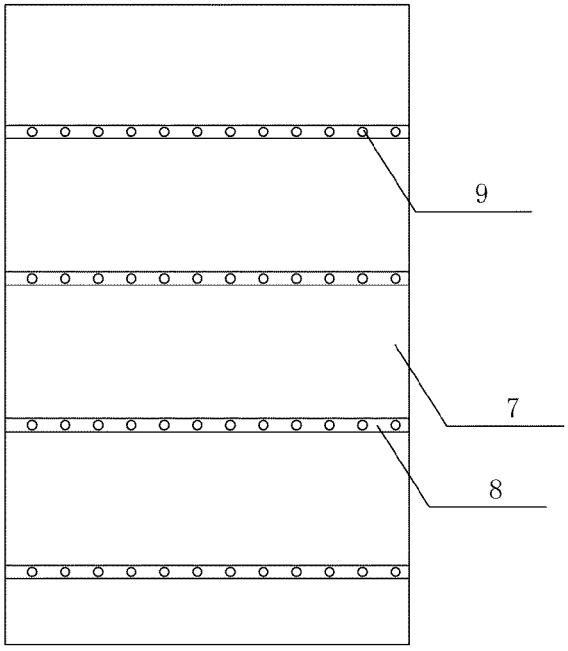
FIG. 4 is a perspective view of a protection member according to the above preferred embodiment of the present invention.

Referring to FIG. 1 of the drawings, a grouted tubular energy-dissipation unit according to the first embodiment comprises an inner tube 1 and an outer tube 2. The inner tube 1 is coaxially inserted into the outer tube defining a lapping portion between the inner tube and the outer tube. The outer surface of the inner tube 1 and the inner surface of the outer tube 2 are prepared by sandblasting and shot blasting. An outer annular plate 4 is provided on an outer end of the lapping portion of the inner tube 1 and the outer tube 2; an inner annular plate 5 is provided on an inner end of the lapping portion of the inner tube 1 and the outer tube 2, as shown in FIG. 2. The outer annular plate 4 and inner annular plate 5 are fixedly connected with the outer tube 2. The inner annular plate 5, outer annular plate 4, the inner tube 1 and the outer tube 2 define a grouting cavity 3. The grouting cavity 3 has a grouting hole provided on a wall thereof for receiving expansive cement grout forming an expansive ring. A reinforcing steel bar 10 is provided inside the grouting cavity 3, as shown in FIG. 3. The reinforcing steel bar can adopt wire mesh panels. A shear key 6 is provided on the inner surface of the outer tube within the lapping portion. As shown in FIG. 4, a metal skin 7 peripherally coats on the outer surface of the inner tube 1. A plurality of spaced steel bars 8 distributed along the axis of the inner tube is provided on the outside surface of the metal skin. A plurality of steel headers extruding outwardly along a radical direction of the inner tube is provided on the steel bar. The metal skin 7, steel bar 8 and steel header form a protection member.

When the expansive cement grout is injected into the grouting cavity 3, the expansive cement grout after solidified is expanded to form an expansive ring. Because the inner and outer tube constrains the expansion of the expansive ring, a radical prestress is produced between the expansive ring and the inner and outer tube so as to increase the friction between the expansive ring and the inner and outer tube. When there is a relative displacement between the inner and outer tube in earthquake, the friction between the sliding surfaces dissipates the energy inputted from vibration of base so as to absorb energy.

Due to the outer annular plate 4 and the inner annular plate 5 added to both ends of the expansive ring, the expansive ring is constrained in three directions, which increases the prestress of the expansive ring within the lapping portion. The outer annular plate 4 and inner annular plate 5 can be both used or only one of them is used. Because the outer annular plate 4 and the inner annular plate 5 constrain the relative displacement between the expansive ring and the outer tube, the slippage will occur on the contact surface of the inner tube and the expansive ring instead of the contact surface of outer tube and the expansive ring. When the shear key is provided on the inner surface of the outer tube, the shear strength between the outer tube and the expansive ring contributed by the mechanical connection between the expansive ring and the shear key, so as to prevent the slippage between the outer tube and expansive ring. This configuration is beneficial to the performance of the energy dissipation unit of the present invention. The reinforcing steel bar can prevent the development of crack and the disruption of the expansive ring, so as to improve the load-bearing capacity and the hysteresis-energy-absorbing ability of the present invention. The protection member formed by metal skin, steel bars and steel headers can protect the inner surface of the expansive ring from degeneration and disruption.

The metal skin 7 is peripherally coated onto the inner tube 1. Two edges of the metal skin 7 overlaps and can slide relatively, such that when the expansive cement grout in the grouting cavity 3 is expanding, the sectional diameter of the metal skin shrinks due to the squeezing force of the expansive ring, so that the metal skin 7 can closely coat onto the inner tube 1 to produce a large pressure between the metal skin 7 and the inner tube 1, so as to protect the contact surface between the inner tube and the expansive ring of the present invention.

Figure 5:
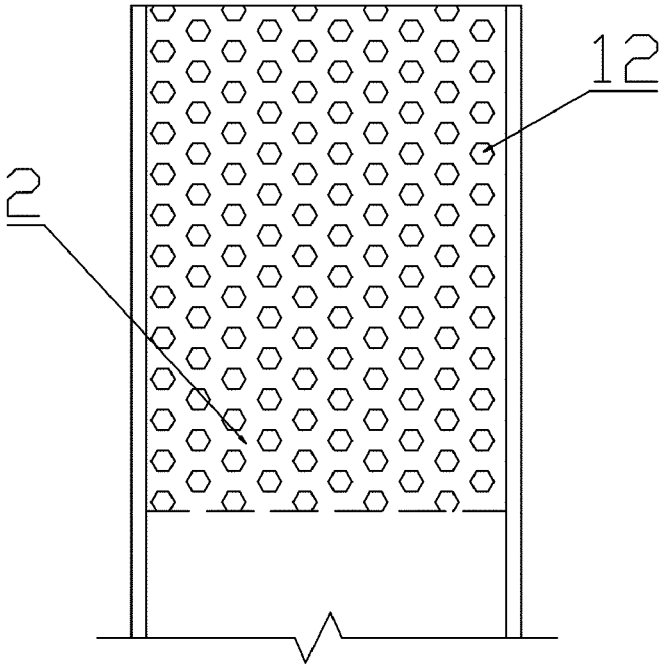
FIG. 5 is a perspective view of a shear key being weld dot according to the above preferred embodiment of the present invention.
Figure 6:
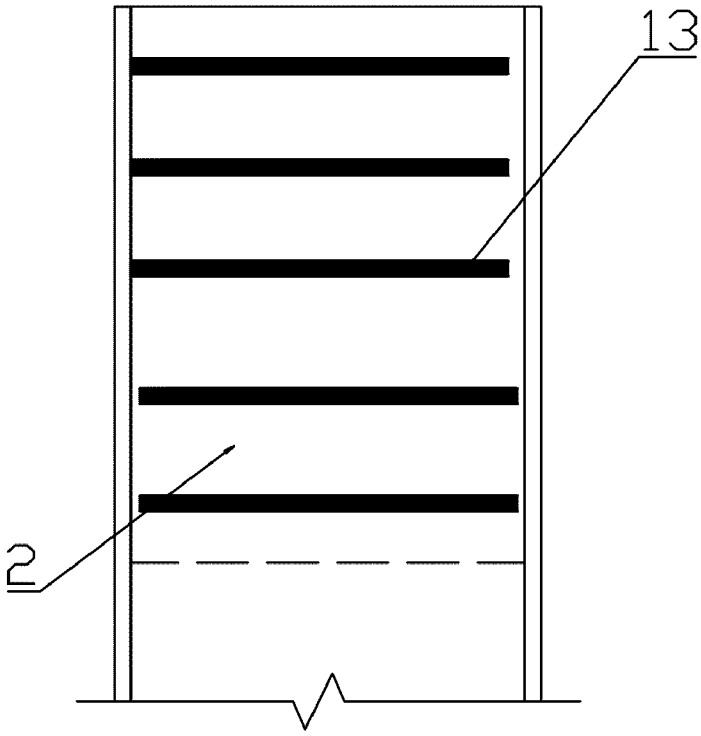
FIG. 6 is a perspective view of a shear key being weld line according to the above preferred embodiment of the present invention.
Figure 7:
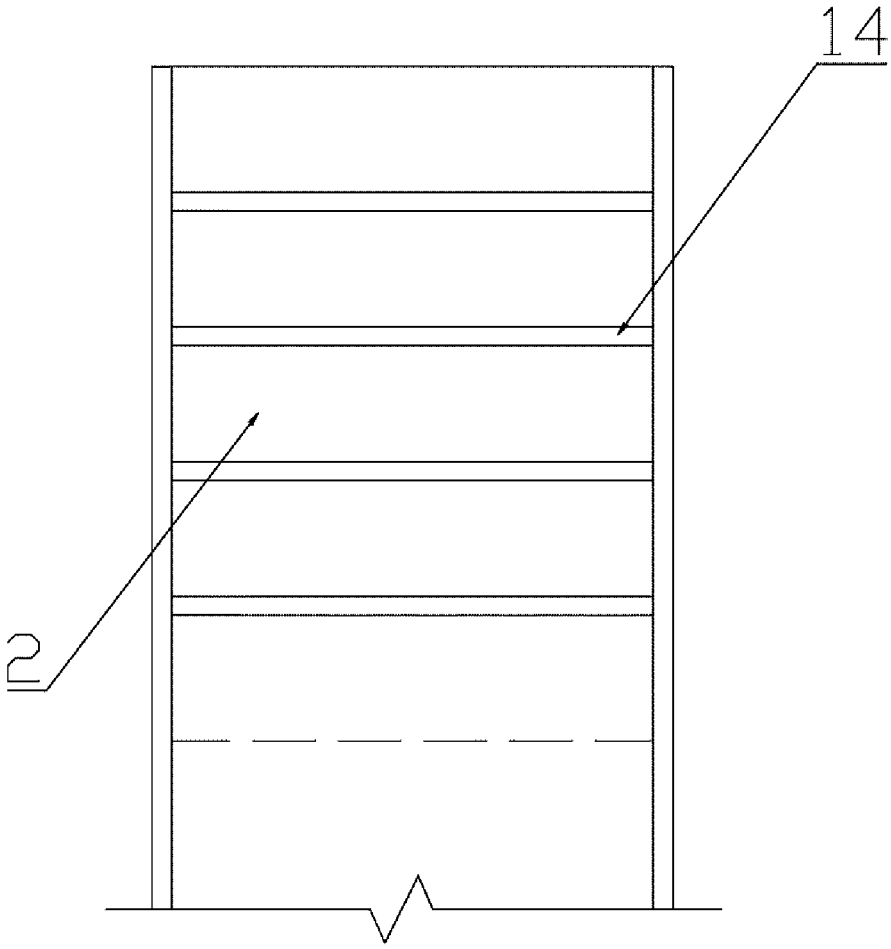
FIG. 7 is a perspective view of a shear key being truncated steel bar according to the above preferred embodiment of the present invention.

In order to inject the grout, the grouting hole can be at any place on the wall of the grouting cavity. The number of the grouting hole can be one or more. As shown in FIG. 2, the grouting hole 11 is on the inner annular plate or outer annular plate. Further, the grouting hole can also on the outer tube. When the grouting hole is on the inner tube 1, the metal skin has a hole at a corresponding place. The shear key is weld dot, as shown in FIG. 5; the shear key is weld line, as shown in FIG. 6; the shear key is truncated steel bar, as shown in FIG. 7, or is a stud. The requirement on welding precise of the shear key does not need to be high, and there is no requirement on the direction of the shear key. The shear key can be randomly placed.

Though expansive ring has high compressive strength, it is easily disrupted when it is subjected to tensive force. Fiber can be added into the expansive cement grout to improve its tensive strength. The fiber can greatly improve the energy-absorbing performance of the expansive ring, so as to improve the load-bearing capacity and the hysteresis-energy-absorbing ability of the present invention. The fiber added into the expansive cement grout is selected from the group consisting of carbon fiber, steel fiber, and glass fiber, the type of the fiber and the amount of the fiber are chosen according to the real circumstances. In order to reduce the shrinkage of the expansive ring, sand can be added into the expansive cement.

The energy dissipation performance of the present invention is mainly determined by the size of the element and the expansion ratio of the expansive cement grout. The expanding agent and the mixing proportion of the expanding agent and the expansive cement grout can greatly influence the performance of the present invention.

In normal condition, the present invention can transfer the axial force via the friction between the tubes and the expansive cement grout. During an earthquake, the sliding friction between the tubes and the expansive ring can dissipate energy caused by the earthquake.

The manufacturing process of the present invention is illustrated hereinafter. The size of the inner and outer tube and the lapping portion of the inner and outer tube are determined according to the load-bearing requirement, and the annular plates and elements of the protection member are also determined. The outer annular plate can be manufactured as a whole ring or two half-rings. The grouting hole may be provided on the annular plates. Manufacture inner and outer annular plates and the element of the protection member, and connect the inner and outer annular plates to the outer tube. Weld the shear key evenly and regularly on the inner surface of the outer tube. The reinforcing steel bar is placed between the two annular plates inside the outer tube. Retain the plastic plate to the inner annular plate inside the outer tube so as to limit the length of the grouting cavity. Envelop tightly the metal skin outside the inner tube and fix it with metal wire. Locate the inner tube and the outer tube to make sure that the two tubes are coaxial. The expansive cement grout is mixed according to the mixing proportion. Quickly inject the mixed expansive cement grout into the grouting cavity through the grouting hole, and vibrate the expansive cement grout via striking or other means so as to discharge the air in the expansive cement grout to ensure the compact of the expansive cement grout. Then cover a plastic film on the lapping portion of the tubes.

The above description of the detailed embodiments are only to illustrate the preferred implementation according to the present invention, and it is not to limit the scope of the present invention, Accordingly, all modifications and variations completed by those with ordinary skill in the art should fall within the scope of present invention defined by the appended claims.

What is claimed is:

1. An grouted tubular energy-dissipation unit, comprising: an inner tube and an outer tube, wherein the inner tube is coaxially inserted into the outer tube defining a gap within a lapping portion between the inner tube and the outer tube, wherein an expansive cement grout is provided in the gap, and the expansive cement grout after solidified forms an expansive ring; a connecting flange A is fixed on the out end of the outer tube and a connecting flange B is fixed on the out end of the inner tube, the relative slide between the inner tube and the outer tube dissipates and absorb energy during earthquake; a shear key is provided on an inner surface of the outer tube within the lapping portion, the shear key is weld dot, weld line, truncated steel bar or stud that welded on an inner surface of lapping portion of the outer tube and in the expansive ring.

2. The grouted tubular energy-dissipation unit, as recited in claim 1, wherein a reinforcing steel bar is provided inside the expansive cement grout for enhancing the expansive ring.

3. The grouted tubular energy-dissipation unit, as recited in claim 2, wherein the reinforcing steel bar is spiral steel bar or circular wire mesh panel.

4. The grouted tubular energy-dissipation unit, as recited in claim 1, wherein a metal skin peripherally coats on an outer surface of the lapping portion of the inner tube, a plurality of spaced steel bars distributed along an axis of the inner tube is provided on an outside surface of the metal skin, and a plurality of steel headers extruding outwardly along a radical direction of the inner tube is provided on the steel bar.

5. The grouted tubular energy-dissipation unit, as recited in claim 4, wherein two edges of the metal skin overlaps and can slide relatively.

6. The grouted tubular energy-dissipation unit, as recited in claim 4, wherein an outer annular plate is provided on an outer end of the lapping portion of the inner tube and the outer tube; an inner annular plate is provided on an inner end of the lapping portion of the inner tube and the outer tube; the outer annular plate and inner annular plate are fixedly connected with the outer tube; the inner annular plate, outer annular plate, the outer tube and the metal skin enveloped on the inner tube define a grouting cavity; the grouting cavity has a grouting hole provided on a wall thereof; the expansive cement grout is provided inside the grouting cavity.

7. The grouted tubular energy-dissipation unit, as recited in claim 6, wherein the grouting hole is on the inner tube, and the metal skin has a hole at a corresponding place.

8. The grouted tubular energy-dissipation unit, as recited in claim 1, wherein an outer annular plate is provided on an outer end of the lapping portion of the inner tube and the outer tube; an inner annular plate is provided on an inner end of the lapping portion of the inner tube and the outer tube; the outer annular plate and inner annular plate are fixedly connected with the outer tube; the inner annular plate, outer annular plate, the inner tube and the outer tube define a grouting cavity; the grouting cavity has a grouting hole provided on a wall thereof; the expansive cement grout is provided inside the grouting cavity.

9. The grouted tubular energy-dissipation unit, as recited in claim 8, wherein the grouting hole is provided on the inner annular plate, the outer annular plate, or the outer tube.

10. The grouted tubular energy-dissipation unit, as recited in claim 1, wherein fiber or sand is mixed into the expansive cement grout.

11. The grouted tubular energy-dissipation unit, as recited in claim 10, wherein said fiber is carbon fiber, steel fiber, or glass fiber.

* * * * *